US008550840B2

(12) United States Patent
Mann et al.

(10) Patent No.: US 8,550,840 B2
(45) Date of Patent: Oct. 8, 2013

(54) PLUG AND RECEPTACLE ARRANGEMENT WITH CONNECTION SENSOR

(75) Inventors: Phillip V. Mann, Rochester, MN (US); Mark D. Plucinski, Rochester, MN (US); Sandra J. Shirk/Heath, Rochester, MN (US); Arvind K. Sinha, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 65 days.

(21) Appl. No.: 13/297,659

(22) Filed: Nov. 16, 2011

(65) Prior Publication Data

US 2013/0122738 A1 May 16, 2013

(51) Int. Cl.
*H01R 3/00* (2006.01)

(52) U.S. Cl.
USPC ..... 439/489

(58) Field of Classification Search
USPC ..... 438/489, 490, 315, 188, 650–655; 200/51.09–51.12; 340/687
See application file for complete search history.

(56) References Cited

U.S. PATENT DOCUMENTS

| | | | | | |
|---|---|---|---|---|---|
| 3,924,914 | A | * | 12/1975 | Banner | 439/105 |
| 4,421,368 | A | | 12/1983 | Saban | |
| 4,671,597 | A | * | 6/1987 | Grill | 362/253 |
| 4,723,922 | A | | 2/1988 | Rush | |
| 4,747,794 | A | | 5/1988 | Seidler | |
| 4,902,235 | A | | 2/1990 | Tonooka | |
| 5,007,857 | A | * | 4/1991 | Wright | 439/490 |
| 5,320,560 | A | * | 6/1994 | Fladung | 439/490 |
| 5,470,252 | A | * | 11/1995 | Fladung | 439/490 |
| 7,121,707 | B2 | * | 10/2006 | Currie et al. | 362/555 |
| 7,321,313 | B1 | | 1/2008 | Inlow | |
| 7,591,670 | B2 | | 9/2009 | Chen et al. | |
| 7,753,712 | B2 | | 7/2010 | Miki | |
| 2002/0075025 | A1 | | 6/2002 | Tanaka | |
| 2005/0205865 | A1 | | 9/2005 | Kuan et al. | |
| 2010/0267275 | A1 | | 10/2010 | Chin et al. | |
| 2011/0115494 | A1 | | 5/2011 | Taylor et al. | |

FOREIGN PATENT DOCUMENTS

| | | | |
|---|---|---|---|
| EP | 0793300 | A2 | 9/1997 |
| JP | 2005268090 | A | 9/2005 |

OTHER PUBLICATIONS

Deutsch et al. "Electrical Characteristics of High-Performance Pin-in-Socket and Pad-on-Pad Connectors," IEEE Transactions on Components, Packaging, and Manufacturing Technology, Part B: Advanced Packaging, vol. 20, No. 1, pp. 64-77, Feb. 1997.

* cited by examiner

*Primary Examiner* — R S Luebke
*Assistant Examiner* — Harshad Patel
(74) *Attorney, Agent, or Firm* — Isaac J. Gooshaw; Matthew F. Mottice; Robert Williams

(57) ABSTRACT

An electrical connector monitoring system for a plug and receptacle assembly, that includes a plug connected to the plug assembly, a recess located within the plug, an electrically insulative layer disposed in the recess, a wear member disposed on the plug that at least partially traverses the insulated recess and in electrical contact with the plug, a contact member movably connected with a receptacle of the receptacle, and a signal device in electrical connection through a circuit with the plug, wear member, and contact member when the plug is fully seated within the receptacle.

20 Claims, 3 Drawing Sheets

PLUG AND RECEPTACLE ARRANGEMENT WITH CONNECTION SENSOR

FIELD OF THE INVENTION

The present invention relates generally to plug and receptacle arrangements and more specifically to a plug and receptacle arrangement for sensing when the plug is not making reliable connection in the receptacle.

BACKGROUND OF THE INVENTION

For the operation of most electrical devices, there is an electrical connector that includes a pair of complementary assemblies that mate to prove an electrical conductive path through the connector to power the device. An electrical connector is an electro-mechanical device for joining electrical circuits as an interface using a mechanical assembly. In some cases, the connection may be temporary, as for portable equipment or require a tool for assembly and removal. There are many different types of electrical connectors. Connectors may join two lengths of flexible wire or cable, or connect a wire or cable or optical interface to an electrical terminal. In other examples, connectors may be mounted on or associated with cards. In computing, an electrical connector may also be known as a physical interface. Cable connectors connect wires to devices mechanically rather than electrically and are distinct from quick-disconnects performing the latter.

In some electrical connectors, one assembly includes one or more conductive pins or posts, collectively called plugs. Each plug may be mounted to an end of the assembly, wherein one end is mounted with the assembly and the other end is free-standing. The receiving or receptacle assembly includes one or more voids that include an electrical contact. The receptacle assembly voids correspond to the geometry of the plugs and receive the plugs when the two assemblies are connected together. The plugs and electrical contacts of the two assemblies are aligned so that, when the two assemblies of the electrical connector are coupled together, each plug engagingly contacts the corresponding resilient contact.

Each resilient contact is biased by its resilience to assert sufficient contact pressure on the outer surface of the mating pin. Typically, the contacts are positioned in their rest state to extend partially into the axial path of the plugs when the two connector assemblies are aligned but not yet coupled. The plugs deflect the resilient contacts as the two connector assemblies are joined together, so that resilience of the contact presses it against the mating pin post. This ensures a proper electrical path through the mating contact of each connector assembly.

Typically, electrical connectors having a structure as aforementioned have a limited useful life in the amount of times the assemblies may be connected and disconnected due to premature contact wear. This is especially the case in applications where noble or precious metals coat or are placed in suitable locations on the plugs and/or the contacts, in order to make the electrical connector more corrosion resistant and to improve electrical conductivity in the plug-to-contact connection. The coated contact surfaces of the plugs and contacts may eventually wear away by the repeated connection and disconnection of the assemblies of the electrical connector. Once the coated surfaces wear away, the untreated material of the plug and/or contact exposed, so that the surface may be more susceptible to corrosion and the conductivity in the electrical connector may be reduced due to reduced contact area between the plugs and contacts. An additional problem with worn connectors is that the worn connectors may damage the mating connector. In this scenario, the tester with the worn connector may damage the part that it is testing.

In one such example, the use of pluggable connectors for memory or bus functions requires reliable connectors that need to be installed during the system bring-up or general availability. Typically, when an interface card is plugged, there is no direct method of establishing how many times these aforementioned connectors have been actuated before GA. A reference guide typically exists from the manufacturer or supplier that specifies the recommended maximum pluggable count for the connector. However, there is no direct way to obtain the amount of pluggable counts for the connector other than manual counting of each connection. As such, what is needed is a way to dynamically count the amount of cycles the electrical connector has been connected.

SUMMARY

An electrical connector monitoring system for a plug and receptacle assembly, that includes a plug connected to the plug assembly, a recess located within the plug, an electrically insulative layer disposed in the recess, a wear member disposed on the plug that at least partially traverses the insulated recess and in electrical contact with the plug, a contact member movably connected with a receptacle of the receptacle, and a signal device in electrical connection through a circuit with the plug, wear member, and contact member when the plug is fully seated within the receptacle.

In examples of the system, when the contact member is in electrical connection with the contact member when the plug is fully seated within the receptacle and the signal device indicates the assembly is not worn. Additionally, when the wear member has worn through the contact member is not in electrical connection with the plug, the signal device indicates the assembly is worn.

DETAILED DESCRIPTION

The present invention will now be described in detail with reference to the figures.

Figure 1:
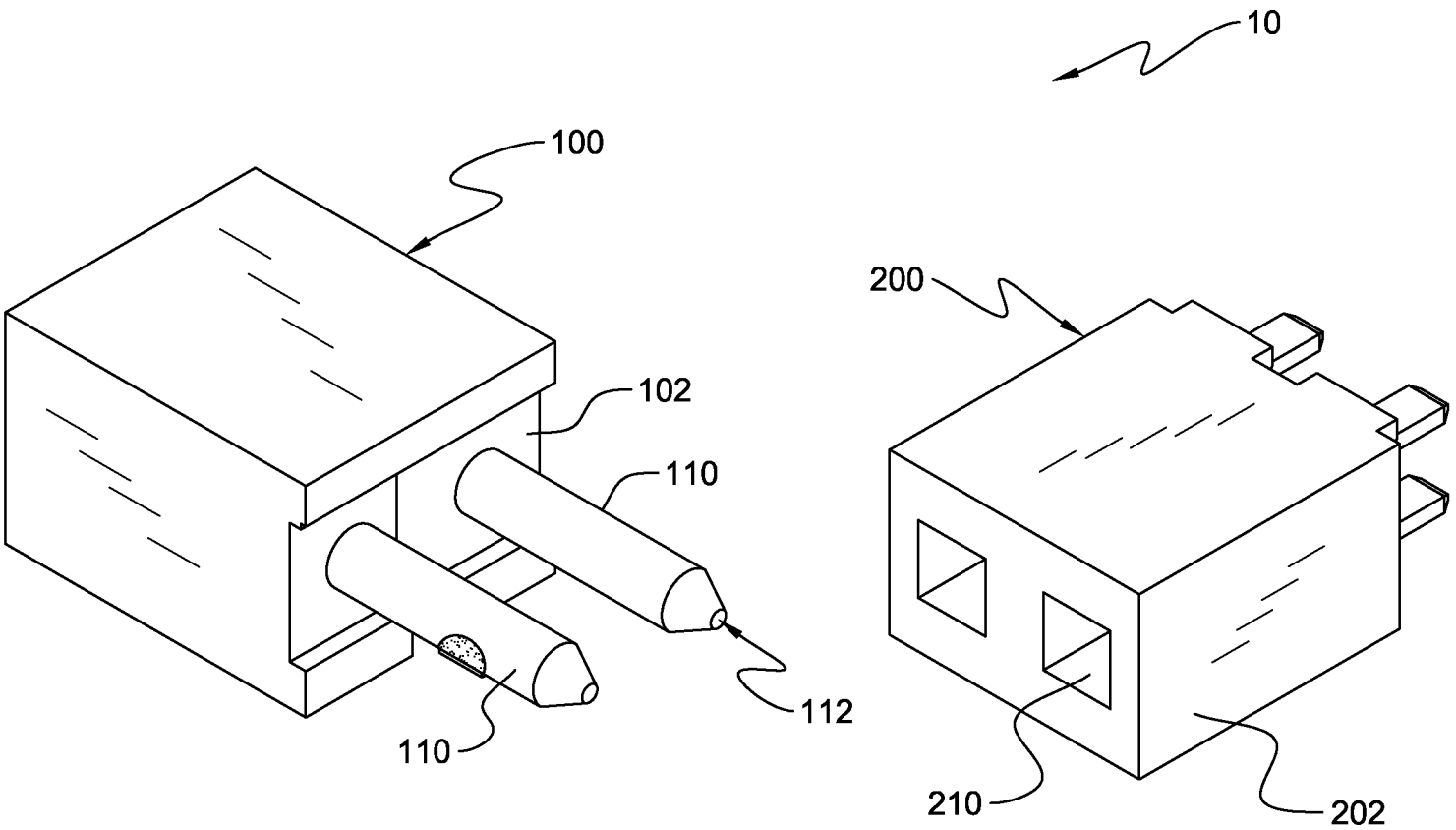
FIG. 1 depicts an example of a conventional plug and receptacle assembly that includes an example of an electrical connector monitoring system according to the present invention.

FIG. 1 illustrates a conventional plug and receptacle assembly type electrical connector 10. The typical connector 10 includes a plug assembly 100 and a receptacle assembly 200 that are adapted to be coupled together. The plug assembly includes one or more plugs 110 which are typically mounted on or in an insulating housing 102 and project outwardly to expose a free-standing end 112. The receptacle assembly includes one or more receptacles 210. In this example, the one or more receptacle are mounted on or in an insulated housing 202. The receptacles 210 may extend outwardly from the housing 202 or the connector or be contained therewithin. The respective insulative housings 202 serve to support other mating elements. Examples of connectors 10 may join two lengths of flexible wire or cable, or connect a wire or cable or optical interface to an electrical terminal. In other examples, connectors 10 may be mounted on or associated with cards or testing units.

Figure 2:
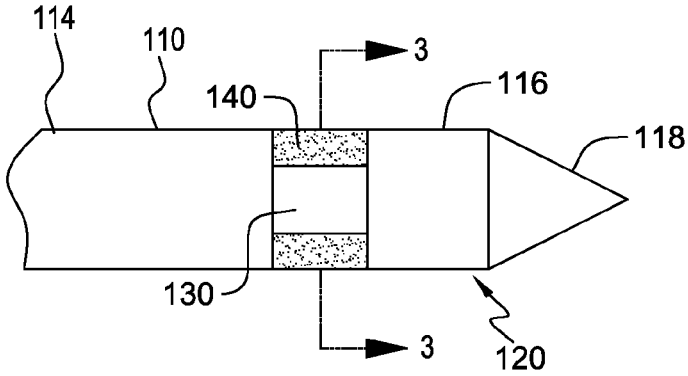
FIG. 2 depicts a top plan view of an example of a plug of an electrical connector monitoring system according to the present invention.
Figure 3:
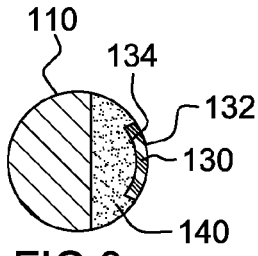
FIG. 3 depicts a front elevated cross-sectional view of the plug of FIG. 2.

FIGS. 2-3 illustrates a portion of the plug assembly for an electrical connector monitoring system generally designated 10 according to one embodiment of the present invention. FIGS. 2-3 provide only an illustration of one implementation and does not imply any limitations with regard to the environments in which different embodiments may be implemented. Many modifications to the depicted environments may be made. Although the examples may depict the plug and receptacle assembly used in an electrical connector, as seen in FIG. 1, exemplary embodiments of the plug and receptacle assembly may be implemented in any number of environments and with any number of different electrical connectors. Additionally, more than one plug and corresponding receptacle may include the monitoring system.

As depicted in FIGS. 2 and 3, an example of the plug and receptacle assembly 100 includes one or more plugs 110. In some examples, the plugs 110 are of a unitary construction machined from a single piece of metal with a generally cylindrical geometry. A solid rear portion 114, has a generally larger cross-sectional diameter than the forward portion 116. The forward portion 116 is adapted to be inserted within the corresponding receptacle 210 of the receptacle assembly 200. The forward portion 116 is generally cylindrical in cross-sectional geometry. In this example, the forward portion 116 is substantially the same diameter along the entire length apart from a tip 118. The tip 118 is generally conical in geometry to facilitate insertion of the plug 110 within the corresponding receptacle 210. Any number of electrically conductive metals may be used to fabricate the plug 110.

In an alternative embodiment, the forward portion 116 may taper from the rear portion 114 to the freestanding end 112 to facilitate insertion of the plug 110 within the corresponding receptacle 210. Additionally, the tip 118 may be any geometry that allows and/or facilitates insertion of the plug 110 within the receptacle 210, including, but not limited to: hemispherical, substantially conical, etc.

In another example, the system is a leaf spring design where the plug 110 and/or corresponding contact member 220 are substantially flat (not shown). In a further example, the system is a leaf spring design where the plug 110 and/or corresponding contact member 220 are situated on a card edge that includes conductive pads plated on the card.

The tip and front portion of the plug 110 are plated 120 with a noble or precious metal, such as, for example gold, to attain an optimal electrical connection between the plug 110 and corresponding receptacle 210. However, during the life of the electrical connector 10, the plug assembly 100 is repeated engaged within and extracted from the receptacle assembly 210. The repetitive contact between the plug 110 and the corresponding receptacle 210 may cause the metal plating 120 to wear away from the plug 110 and/or the receptacle 210. In addition to the wearing away of the metal plating 120, the receptacle may lose some spring tension, causing the electrical connection to deteriorate.

Figure 4:
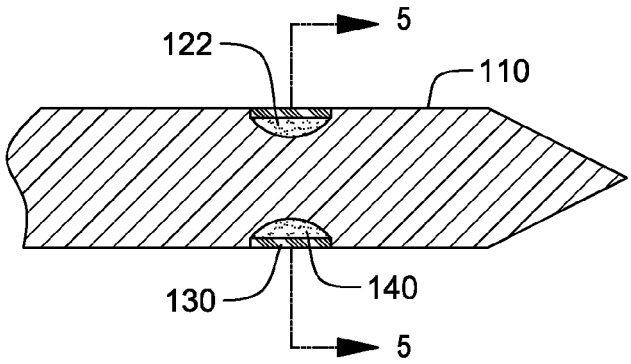
FIG. 4 depicts a top plan view of an example of a plug of an electrical connector monitoring system according to the present invention.

As depicted in FIGS. 2 and 3, at least one plug 110 of the plug assembly 100 includes a wear member 130 that traverses an electrically insulative layer 140 disposed in a recess 122, as seen in FIG. 4, of the plug 110. The wear member 130 is fabricated from a controlled thickness of conductive material. The thickness of the wear member is controlled and calibrated to wear through when the connector has reached the maximum number of insertion and extraction cycles allowed for the connector, thereby providing a visual indicator that the connector has reached a maximum desired number of insertion and extraction cycles. In some respects, the use of a wear member 130 may be a better indication than a physical count of the total number of insertions and extractions cycles. The wear member may better indicate the actual wear of the plug and receptacle assembly, as opposed to the number of cycles. In some situations, depending upon the environment, persons using the connector, use of the connector, etc., may differentiate and produce more or less wear on the electrical connector. As such, the wear member 130 may impart superior indication of actual wear of the electrical connector, as opposed to just an amount of insertion and extraction I cycles.

In this example, the wear member 130 partially encircles the periphery of the plug 110. An exposed outer surface 132 of the wear member has a radius of curvature that is substantially the same as the radius of curvature of an exposed outer surface of the front portion of the plug. The wear member 130 is fabricated from the same material used to plate the rest of the forward portion 116 and tip 118 of the plug. However, in other examples, the wear member 130 may be fabricated from a material different from the material used to plate the front portion 116 and the tip 118 of the plug. Typically, the wear member 130 is fabricated from a noble or precious metal, such as, for example gold. In alternate examples, the wear member 130 may have different geometries that allow a sufficient electrical connection when the plug 110 is fully seated within the corresponding receptacle 210.

At least one plug of the plug assembly includes an electrically insulative layer 140 disposed in a recess 122 of the forward portion 116. The insulated recess 140 includes an insulating material that insulates at least portion of the wear member 130 from the forward portion 116 of the plug 110. In this example, the entire lower surface 134 of the wear member 130 is insulated from the forward portion 116 by the insulative layer 140. The insulating material may be, but not limited to: plastics, fiberglass, ceramic, etc.

Figure 5:
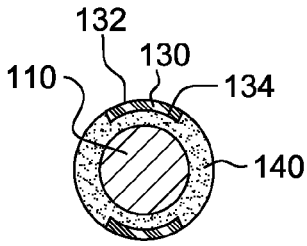
FIG. 5 depicts a front elevated cross-sectional view of the plug of FIG. 4.

In an alternative example, as depicted in FIGS. 4 and 5, more than one wear member 130 partially encircles the periphery of the plug 110, with at least a portion of the wear member 130 unattached with the forward portion 116.

In an alternative example, as depicted in FIGS. 4 and 5, the insulative layer 140 encircles the entire periphery of a portion of the plug 110. In this example, more than one wear member 130 is associated with the plug 110. By including more than one wear member, the system 10 may obtain a superior estimation as to whether or not the plug and receptacle assembly should be replaced. More than one wear member on the plug may provide a larger baseline to compare whether or not the plug assembly is worn more than desired.

Figure 6:
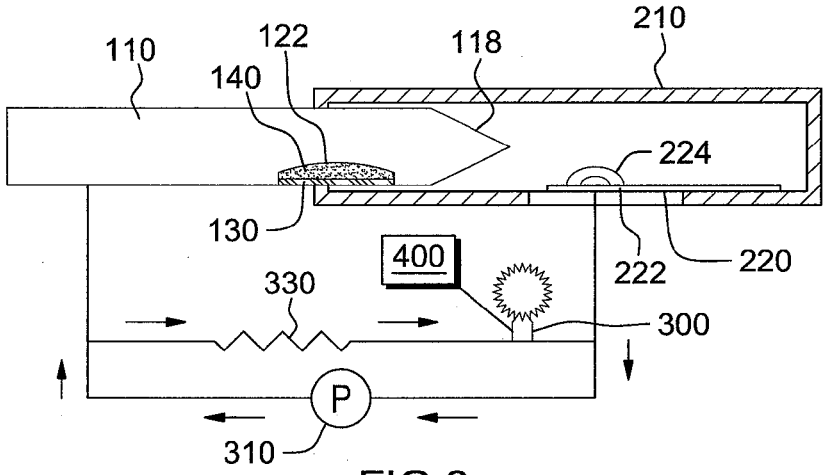
FIG. 6 depicts a plug of the electrical connector of FIG. 2 prior to being seated within a receptacle according to the present invention.
Figure 7:
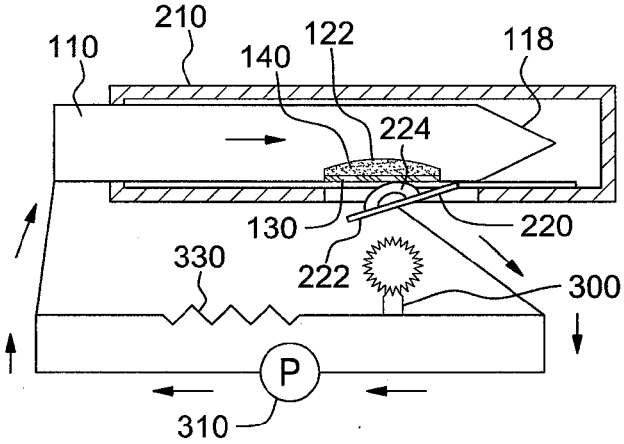
FIG. 7 depicts the plug of FIG. 2 after being fully seated within the receptacle, where the wear member is not worn, according to the present invention.

In this example, the cross-sectional geometry of the receptacle 210 is substantially circular to complement and receive the plug 110, as depicted in FIGS. 6 and 7. In alternate embodiments, the cross-sectional geometry of the receptacle 210 may be rectangular, polygonal, or other geometries that complement and receive the exterior cross-sectional geometry of a corresponding plug of the plug assembly. In whatever example, whenever the plug assembly 100 is fully seated within the receptacle assembly 200, the one or more wear members 130 contact and provide an electrical connection with corresponding contact members 220. As such, the plug and receptacle assemblies are fabricated to negate the possibility of the plug assembly 100 being fully seated within the receptacle assembly 200 and the wear member 130 is misaligned to contact the contact member 220. In this example, the placement of the multiple plugs of the plug assembly only allow for insertion within the receptacle assembly in one orientation. In other embodiments, the plug and/or receptacle assemblies may utilize keys to facilitate proper alignment.

The receptacle 210 includes the contact member 220 movably connected thereto. In this example, the contact member 220 is pivotably connected with the receptacle 210, although other examples may use other forms of movable connections. In an example, the receptacle is spring loaded or utilizes metal compression. The contact member 220 includes a base portion 222 and an upper portion 224. The base portion 222 is generally cuboid and the upper portion 224 is generally c-shaped in geometry, with each end connected to the base portion 222. However, in other embodiments, the base portion 220 may have different geometries that allow for an electrical connection between the contact member 220 and the inserted plug 110.

Typically, the contact member 220 is fabricated from a noble or precious metal, such as, for example gold. In alternate examples, the wear member 220 may have different geometries that allow a sufficient electrical connection when the plug 110 is fully seated within the corresponding receptacle 210.

In this example, the contact member 220 is resilient, with the upper portion 224 projecting into the axial path of the wear member 130 of the corresponding plug 110, when seating the plug 110 within the receptacle 210. The wear member 130 of the plug 110 will engage the upper portion 224 of the contact member 220, causing the contact member 220 to bias in a cantilever fashion, until the plug 110 is fully seated within the receptacle 210, as depicted in FIG. 7. When the plug 110 is fully seated within the receptacle 210, the wear member 130 is in electrical contact with the upper portion 224 of the contact member 220. When extracting the plug 110, the resiliency of the contact member 220 causes the contact member 220 to bias back into the original position, as depicted in FIG. 6.

Figure 8:
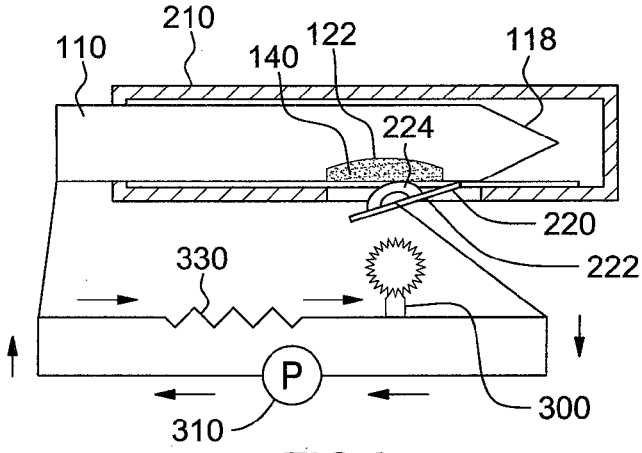
FIG. 8 depicts the plug of FIG. 2 after being fully seated within the receptacle, where the wear member is worn, according to the present invention.

Referring to FIGS. 6-8, the system 10 includes a signal device 300 and a power source 310 in electrical connection through a circuit with the plug 110, wear member 130 and contact member 220 when the plug 110 is fully seated within the corresponding receptacle 210.

The system 10 includes a power source 310, such as a battery. In other embodiments, the power source 310 may be, for example, power wired through a circuit card, power provided by or through the tester, etc.

In this example, the signal device 300 is an LED light. However, in other alternate embodiments, the signal device 300 may be an audio signal, such as an alarm bell, other visual signals, electrical signals, and/or a combination of these forms of signal devices or other known signal devices. In examples, the detection circuit could be wired to prevent the system, card or tester from powering up, or could result in shutting the system, card or tester down.

In one specific alternate example, the signal device 300 is a sensor connected to a microprocessor (400), as depicted in FIG. 6, which processes signals received from the sensor. In this example, the signal device may include memory connected to the microprocessor that is located on or off the microprocessor. The memory may count the amount of insertions and/or extractions of the plug and receptacle assemblies.

As aforementioned, the plug 110 and receptacle 210 are connected to a circuit containing the power source 310 and the signal device 300, as depicted in FIGS. 6-8. In this example, the circuit is designed with a resistor 330 in the path of the signal device 300 through which the current flows when the plug and receptacle assemblies 100 and 200 are not fully seated, thereby activating the signal device 300. When the plug and receptacle assemblies 100 and 200 are fully seated, the current bypasses the path containing the resistor 330 and signal device 300, and flows through the plug 110, the wear member 130, and the contact member 220, causing the signal device 300 to deactivate.

However, after a number of cycles of inserting and extracting the plug 100 within the receptacle 200, the wear member 130 deteriorates and/or begins wears away. Eventually, when the number of cycles of inserting and extracting the plug 100 within the receptacle 200, the wear member 130 will be worn away and the contact member 220 will rest on the insulated recess 140 of the plug 110, instead of contacting the wear member 130, resulting in the current flowing through the circuit path containing the resistor 330 and signal device 300, activating the signal device 300.

Based on the foregoing, an electrical connector monitoring system for a plug and receptacle assembly have been disclosed. However, numerous modifications and substitutions can be made without deviating from the scope of the present invention. Therefore, the present invention has been disclosed by way of example and not limitation.

What is claimed is:

1. An electrical connector monitoring system for a plug and receptacle assembly, comprising:

a plug connected to the plug assembly;

a recess located within the plug;

an electrically insulative layer disposed in the recess;

a wear member disposed on the plug that at least partially traverses the insulated recess and is in electrical contact with the plug;

a contact member moveably connected with a receptacle of the receptacle assembly; and a signal device in electrical connection through a circuit with the plug, the wear member, and the contact member when the plug is fully seated within the receptacle;

whereby the wear member is in electrical connection with the contact member when the plug is fully seated within the receptacle and the signal device indicates the assembly is not worn; and whereby when the wear member has worn through the contact member is not in electrical connection with the plug, the signal device indicates the assembly is worn.

2. The system of claim 1, wherein a surface of the wear member and a surface of the contact member that are in electrical connections when the plug is fully seated within the receptacle are plated with a noble metal.

3. The system of claim 1, wherein the signal device is a light source.

4. The system of claim 1, wherein the plug and receptacle assembly are electrically connected to a circuit containing a power source and a light source, when the plug is fully seated within the receptacle, the light source remains unlit when the wear member has not worn out, and the light source remains lit when the wear member is worn out.

5. The system of claim 1, wherein the signal device is associated with the plug.

6. The system of claim 1, wherein the signal device is associated with the receptacle.

7. The system of claim 1, wherein the contact member is resilient.

8. The system of claim 1, wherein a surface of the wear member and a surface contact member that are in electrical connection are plated with the same metal.

9. The system of claim 1, wherein the contact member is piovtably connected with the receptacle of the receptacle assembly.

10. The system of claim 1, wherein the signal device produces an audible warning when the contact member is worn.

11. The system of claim 1, wherein the signal device is a sensor connected to a microprocessor that processes signals received from the sensor.

12. An electrical connector monitoring system for a plug and receptacle assembly, comprising:

a plug connected to the plug assembly;

a recess located within the plug;

an electrically insulative layer disposed in the recess;

a wear member disposed on the plug that at least partially traverses the insulated recess and is in electrical contact with the plug;

a contact member moveably connected with a receptacle of the receptacle assembly; and a signal device in electrical connection through a circuit with the plug, the wear member, and the contact member when the plug is fully seated within the receptacle;

wherein a surface of the wear member and a surface of the contact member that are in electrical connections when the plug is fully seated within the receptacle are plated with a same noble metal;

whereby the wear member is in electrical connection with the contact member when the plug is fully seated within the receptacle and the signal device indicates the assembly is not worn;

whereby when the wear member has worn through the contact member is not in electrical connection with the plug, the signal device indicates the assembly is worn.

13. The system of claim 12, wherein the signal device is a light source.

14. The system of claim 12, wherein the plug and receptacle assembly are electrically connected to a circuit containing a power source and a light source, when the plug is fully seated within the receptacle, the light source remains unlit when the wear member has not worn out, and the light source remains lit when the wear member is worn out.

15. The system of claim 12, wherein the signal device is associated with the plug.

16. The system of claim 12, wherein the signal device is associated with the receptacle.

17. The system of claim 12, wherein the contact member is resilient.

18. The system of claim 12, wherein the contact member is piovtably connected with the receptacle of the receptacle assembly.

19. The system of claim 12, wherein the signal device is a sensor connected to a microprocessor that processes signals received from the sensor.

20. An electrical connector monitoring system for a plug and receptacle assembly, comprising:

a plug connected to the plug assembly;

a recess located within the plug;

an electrically insulative layer disposed in the recess;

a wear member disposed on the plug that at least partially traverses the insulated recess and is in electrical contact with the plug;

a contact member resiliently connected with a receptacle of the receptacle assembly; and a light source in electrical connection through a circuit with the plug, the wear member, and the contact member when the plug is fully seated within the receptacle;

wherein a surface of the wear member and a surface of the contact member that are in electrical connections when the plug is fully seated within the receptacle are plated with a same noble metal;

wherein the plug and receptacle assembly are electrically connected to a circuit containing a power source and a light source, when the plug is fully seated within the receptacle, the light source remains unlit when the wear member has not worn out, and the light source remains lit when the wear member is worn out.

* * * * *